US010655941B2

(12) United States Patent
Brockel

(10) Patent No.: US 10,655,941 B2
(45) Date of Patent: May 19, 2020

(54) ATTACHABLE INTERACTIVE MODULAR SHOOTING SYSTEM

(71) Applicant: Trigger Interactive, LLC, Le Claire, IA (US)

(72) Inventor: Tyler Brockel, Le Claire, IA (US)

(73) Assignee: Trigger Interactive, LLC, Le Claire, IA (US)

( * ) Notice: Subject to any disclaimer, the term of this patent is extended or adjusted under 35 U.S.C. 154(b) by 147 days.

(21) Appl. No.: 16/048,163

(22) Filed: Jul. 27, 2018

(65) Prior Publication Data

US 2019/0063882 A1 Feb. 28, 2019

Related U.S. Application Data

(60) Provisional application No. 62/537,762, filed on Jul. 27, 2017.

(51) Int. Cl.

| | |
|---|---|
| ***F41J 1/01*** | (2006.01) |
| ***F41J 5/04*** | (2006.01) |
| ***F41J 11/00*** | (2009.01) |
| ***F41J 5/14*** | (2006.01) |
| ***F41J 7/06*** | (2006.01) |
| ***F41J 5/02*** | (2006.01) |

(52) U.S. Cl.

CPC . *F41J 1/01* (2013.01); *F41J 5/02* (2013.01); *F41J 5/04* (2013.01); *F41J 5/14* (2013.01); *F41J 7/06* (2013.01); *F41J 11/00* (2013.01)

(58) Field of Classification Search

None

See application file for complete search history.

(56) References Cited

U.S. PATENT DOCUMENTS

| | | | | |
|---|---|---|---|---|
| 2003/0091960 | A1* | 5/2003 | Rosa | F41G 3/2655 434/21 |
| 2005/0153262 | A1* | 7/2005 | Kendir | F41G 3/2655 434/21 |
| 2006/0290063 | A1* | 12/2006 | Hagar | F41J 7/04 273/369 |
| 2012/0043722 | A1* | 2/2012 | Mironichev | F41J 7/04 273/406 |
| 2015/0247709 | A1* | 9/2015 | Roberts | F41J 5/14 340/540 |
| 2016/0195369 | A1* | 7/2016 | Perry | F41J 7/04 434/19 |

* cited by examiner

*Primary Examiner* — Jay Trent Liddle
*Assistant Examiner* — Alex F. R. P. Rada, II
(74) *Attorney, Agent, or Firm* — Incubate IP; Randy R. Micheletti

(57) ABSTRACT

A target shooting system is described. The system can include at least one target signal/sensor assembly, the target signal/sensor assembly including an active target signal, an active target signal actuator, at least one hit sensor, and a target signal/sensor transceiver. The system can also include a round counter configured to be attached to a weapon and to sense firing of a projectile from the weapon, the round counter including a projectile firing sensor, a round counter processor and a round counter transceiver. The system can further include a computing device configured to communicate with the at least one target signal/sensor assembly and the round counter.

19 Claims, 6 Drawing Sheets

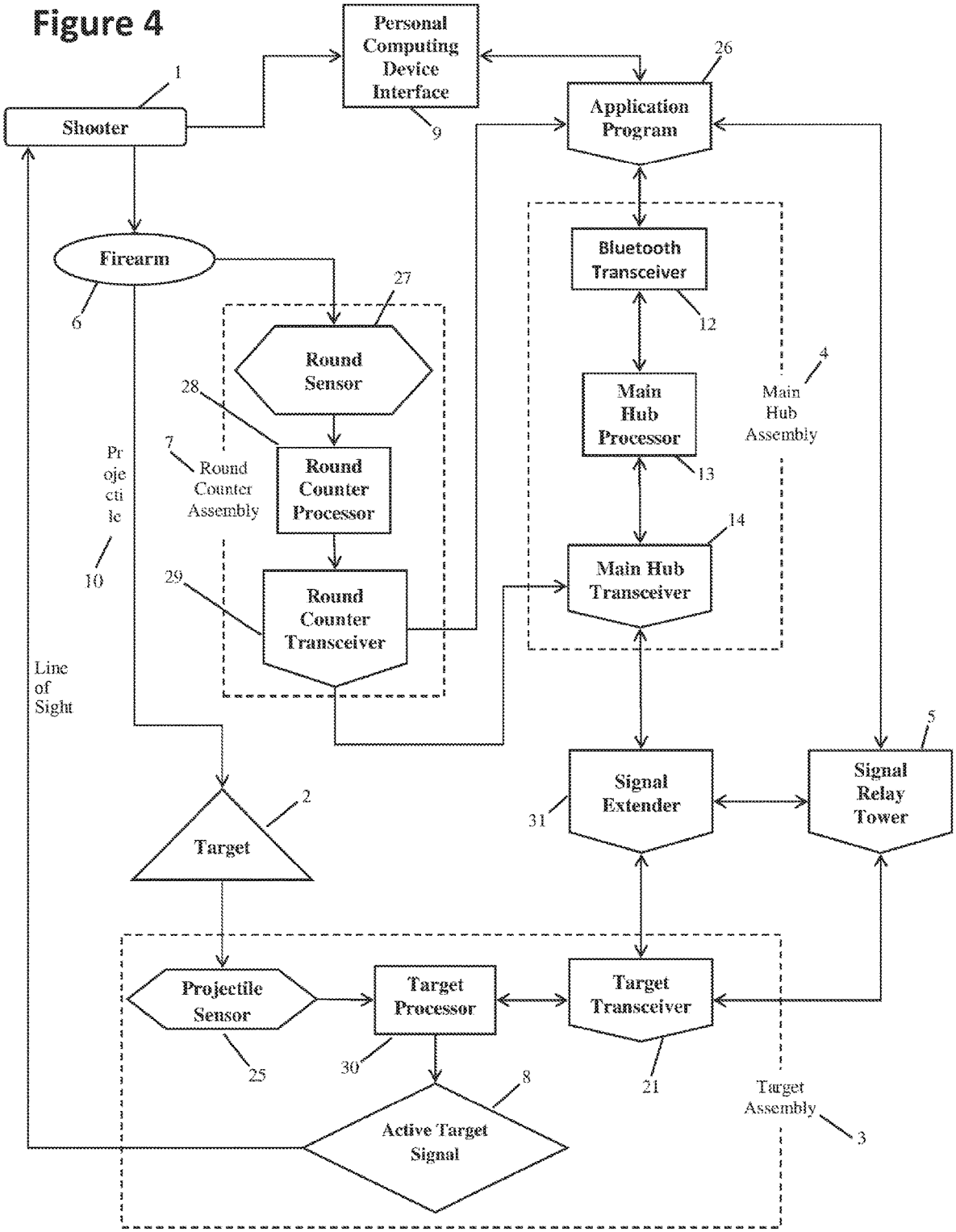
Figure 4
Personal Computing Device Interface
9
Shooter
1
Application Program
26
Firearm
6
Bluetooth Transceiver
12
27
Round Sensor
28
Round Counter Processor
7
Round Counter Assembly
Main Hub Processor
13
Main Hub Assembly
4
Projectile
10
29
Round Counter Transceiver
Main Hub Transceiver
14
Line of Sight
Signal Extender
31
Signal Relay Tower
5
Target
2
Projectile Sensor
25
Target Processor
30
Target Transceiver
21
Active Target Signal
8
Target Assembly
3

ATTACHABLE INTERACTIVE MODULAR SHOOTING SYSTEM

RELATED APPLICATIONS

This application claims the benefit of U.S. Application No. 62/537,762, entitled "Attachable Interactive Modular Shooting System," filed on Jul. 27, 2017, which is incorporated herein by reference in its entirety.

FIELD

Some implementations relate generally to a target shooting system, and more specifically, to an attachable interactive modular target shooting system for use with stationary targets that converts the stationary targets into dynamic and interactive target shooting system.

BACKGROUND

Target shooting is a widespread activity in military and law enforcement personnel training, personal defense training, competition shooting sports, and recreational shooting sports with the common goal to improve shooter marksmanship skills.

Cardboard or paper targets are a commonly used solution at firing ranges. However, there are several disadvantages to this method. The targets are damaged with every bullet hit, targets wear down quickly, and the targets have to be replaced by hand periodically. Scores or location of impacts are recorded by visual inspection of the targets and require the range to shutdown periodically for shooters to record their scores and replace their targets. In addition to inefficiency, shooting stationary paper targets lacks realism in training scenarios and provides relatively low entertainment value.

To rectify this, systems have been developed that prompt users when to shoot certain targets and record their hits and misses then display the data to them in real time. These types of systems offer a more efficient, entertaining, and realistic shooting experience to users.

Various conventional target and shooting systems may signal a shooter to shoot a target when activated and react with some form of output when the target is hit. Some conventional systems may utilize the target itself as the activation signal. For example, some conventional target solutions may rotate a target from a "don't shoot" side to a "shoot" side and back again. Some conventional systems may utilize proprietary targets that limit a user's choice of target. Also, some conventional system may use proprietary targets that include target system components built into the targets.

Some implementations of the present disclosure were conceived in light of the above mentioned problems and limitations, among other things.

SUMMARY

In accordance with one aspect of the disclosed subject matter, the Attachable

Interactive Modular Shooting System (AIMSS) is a modular and expandable system of electronic devices that permits a user to turn any type of metallic firearm targets, or any other form of penetrable or impenetrable firearm targets, into a dynamic and interactive shooting experience. Individual signal and sensor apparatuses, which signal a user when to shoot a specific target and record any bullet strikes, attach to each target on a range and wirelessly communicate between themselves, either directly or through a mesh network which can include one or more of a central control hub, a signal extender, a signal relay device, a personal computing device with a graphical user interface (e.g., a smart phone, smart device, personal computer, tablet computing device, or dedicated system controller) or a combination of the above. The user interface, on the personal computing device, can be provided by one or more application program(s) that link to the wireless and modular devices in the system, which can include the signal and sensor attachments on each target, in addition to an optional round counter mounted on the shooter's firearm which reads and records any bullets fired from the firearm (or other projectiles discharged from a weapon system, where the weapon system can include an actual weapon system such as a firearm, and can also include toy weapons (e.g., Nerf guns, etc.), sport/recreational nonlethal weapons (e.g., paintball guns, AirSoft guns, etc.), imitation or simulated weapons (e.g., laser tag weapons, etc.). The system can take inputs from the user to customize a range program that defines the characteristics of a round of target shooting (e.g., number of targets, target activation sequence, speed of activation, etc.) then signal when a specific target(s) is to be activated, deactivate the signal when a target(s) is inactive, record each hit, record each miss, track the number of rounds fired, and track the time to hit each target, among other things. The system can activate a specific number of targets for a set amount of time in a specific order based on the range program and parameters the shooter designates for the range program via the graphical user interface. The system then calculates, records, and displays the resulting data from each round (or iteration) of target shooting. The data displayed is based on the program executed during the iteration (e.g., a standard target shooting iteration, a target shooting game, etc.) and can include such data as, the total number of available targets from the round, the total time elapsed during the iteration, the number of iteration waves achieved, the number of targets hit, the number of targets missed, the shooter's accuracy, and the average time it took the user to hit each target. The target shooting round data can be received at the personal computing device and displayed on a graphical user interface displayed on a display of the personal computing device.

BRIEF DESCRIPTION OF THE DRAWINGS

These and other features and advantages of the disclosed subject matter will be better understood by reading the following detailed description, taken together with the drawings wherein:

FIG. 4 is a flow diagram depicting an example operation of a target system in accordance with some implementations.

DETAILED DESCRIPTION

Some implementations address a need for a realistic and entertaining shooting system, in addition to addressing the issues discussed above. Some implementations utilize existing targets and provide a portable, wireless, and interactive target system. Some implementations also provide real-time feedback via a graphical user interface displayed on a display of a computing device.

Figure 1:
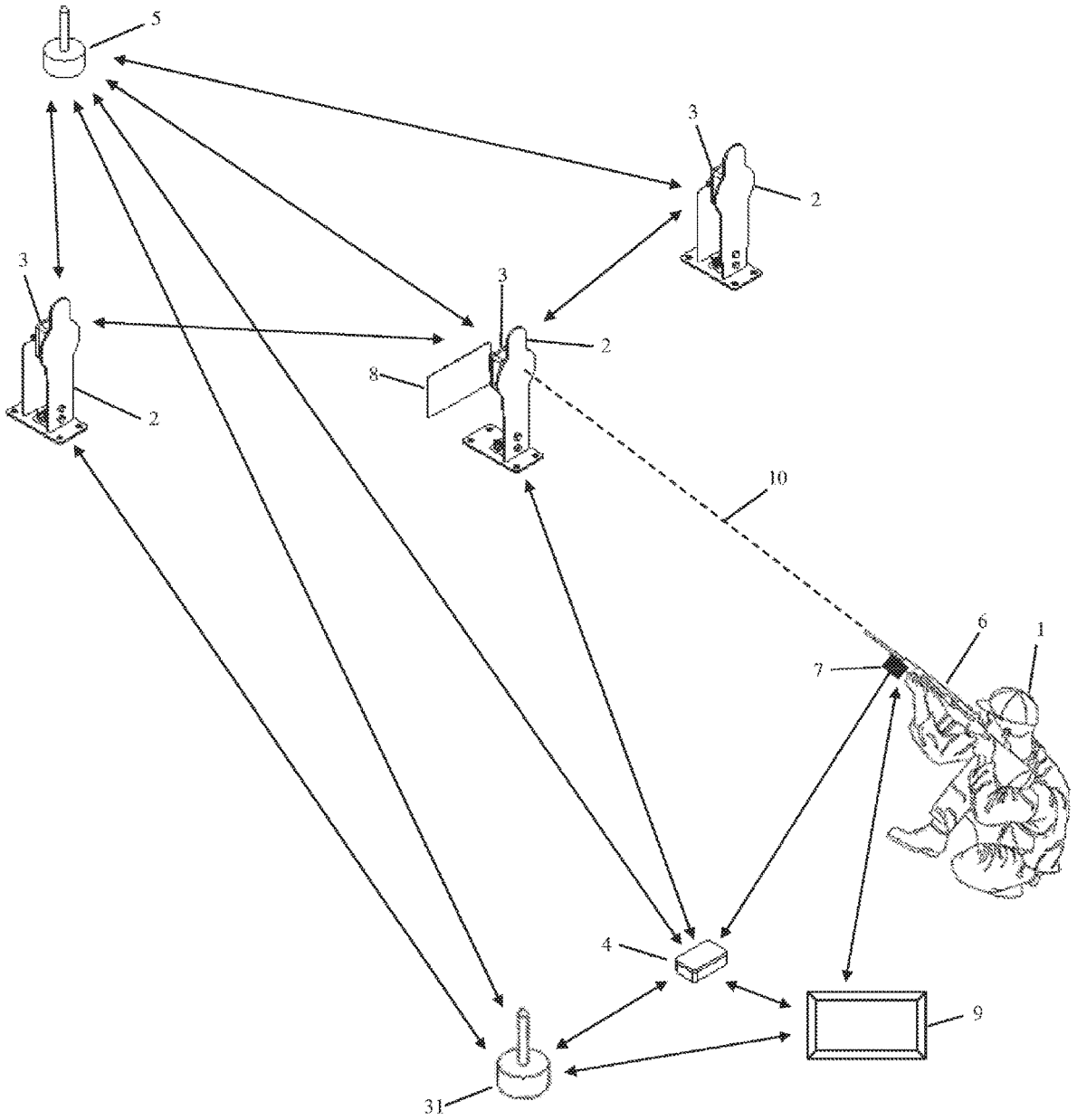
FIG. 1 is a diagram of an example attachable interactive modular shooting system environment in accordance with some implementations.

As shown in FIG. 1, some implementations can include an expandable signal and sensor array that permits a shooter 1 to turn firearm targets 2 into an interactive shooting experience by attaching individual signal/sensor assemblies 3 to corresponding targets.

The system is modular and expandable which allows any of the devices to be added (e.g., paired via wireless or wired connection) or removed at any time with no limit to the number of devices permitted to be added. Depending on the distance of the signal/sensor assemblies from the shooter 1, devices such as a central control hub 4, signal extender 31, or signal relay tower 5 can be added in the system to increase signal reliability. Upon startup of the user's personal computing device, the application program 26, and the modular devices in the system, the system devices, in conjunction with the application program 26, will communicate with each other and either establish a wireless connection or give the shooter 1 the option to establish a wireless connection between any of the devices (either directly from the personal computing device or via an intermediate device such as a central control hub, a wireless extender, or a wireless relay). The shooter 1 then has the option to decide which devices he or she wants to pair to the system, what devices he or she wants to remove from a paired state, and which devices he or she wants identified. A device that is paired to the system can be identified by selecting it in the application program 26 and an LED, or other visual or audible means on the device, will signal the shooter 1 that the device is selected.

The signal/sensor assemblies 3 are wirelessly linked to the user's personal computing device 9, either directly or through any combination of a central control hub 4, signal extender 31, and signal relay tower 5 in addition to a round counter 7 mounted on the shooter's 1 firearm. The signal/sensor assembly 3 is attached to the each target 2 (e.g., on the rear face or side opposite the impact side). The personal computing device 9 can include one or more application programs 26 which link to, and control, the signal/sensor target assemblies 3.

The system will take inputs from the shooter 1 (e.g., via a graphical user interface) to select and customize the application program 26 to select from the pool of available targets 2 and activate the active target signal 8 on each corresponding target 2 according to a given timing pattern stored or generated by the application program 26. The shooter 1 then has a designated amount of time, based on the program and settings designated prior to the initiation of the application program 26, to hit the active target(s) 2 with a projectile 10 from the firearm 6 before the signal/sensor target assembly 3 deactivates and the active target signal 8 is deactivated and disappears from the shooter's 1 line of sight on the selected target 2. This process continues for the designated amount of targets 2 or time corresponding to the inputs the shooter 1 specified in the application program 26.

The application program 26 can record each target hit (e.g., via a target hit sensor), record each miss (e.g., via detecting a round fired, but no corresponding target hit), track the number of rounds fired (e.g., via a round counter attached to the firearm or gun), and calculate the average time it takes the shooter 1 to hit each active target 2, and calculate the shooter's accuracy based on the number of targets 2 hit or the number of projectiles or rounds 10 fired if there is a round counter 7 connected to the system. The data can be displayed (e.g., on the graphical user interface) at the end of each round target shooting on the user interface on the shooter's personal computing device 9 or through a Bluetooth (or other form of wireless communication) enabled personal computing device 9.

FIG. 1 depicts an example system including a central control hub 4, one or more signal/sensor target assemblies 4, a signal relay tower 5, a signal extender 31, a firearm round counter 7, and a Bluetooth enabled (or other wireless communication enabled) personal computing device 9. Additional components of the system can include any type of metallic, or any other form of penetrable or impenetrable firearm targets suitable firearm targets 2 rated for the type of projectile 10 being shot at the targets (e.g., rated for the type of weapon system, type of projectile, caliber being used, etc.), and a firearm 6 that fires the corresponding projectile 10. In some implementation, the components in the system communicate wirelessly using radio frequency transmissions. Alternatively, Bluetooth or a wireless network (e.g., WiFi, etc.) can be used to wirelessly link the components and relay signals within the system. Other communications techniques can be used as well, such as light wave communication or an ANT multicast wireless sensor network The system is expandable (e.g., unlimited number of signal/sensor devices 3 can be paired in the system) which wirelessly link to the user's personal computing device. Once the signal/sensor target assemblies 3, or any component in the system, is powered on or activated, they will be available detected by the user interface 26 and can be paired with the system. The application program 26 will use the number of linked signals from the sensor/signal devices attached to targets to determine the number of available targets 2 on the range. Alternatively, once units in the system have been powered on, the shooter 1 can manually input the number of available targets 2 using user interface 26 on a connected computing device 9 (e.g., a mobile device running an app for interacting with the target system).

The application program 26 prompts the shooter 1 to input how many targets the user wants to shoot in a round of target shooting, which is the total number of times the application program 26 will activate and transmit an active target signal 8 to a target within the pool of available targets 2. The shooter will also input the number of times a target 2 needs to be hit before it deactivates. The shooter 1 will also input the difficulty level setting. The difficulty changes with the target 2 activation time, the amount of deactivation time in between targets 2, and the number of simultaneously activated targets 2.

In FIG. 1, the application program 26 sends a wireless signal using its wireless communication transceiver 14 to a predetermined signal/sensor target assembly 3 attached (e.g., to the rear face) to one of the targets 2 on the range. The rear face of a target 2 is defined as the side opposite of the side that a projectile 10 will impact when the target receives a direct hit from the projectile. In some implementations, the signal/sensor assembly 3 can include a magnetic base 24 that permits the assembly to adhere to the rear face of a steel (or other ferrous metal) target 2, for example. Alternatively, welded fasteners, chemically welded hardware, Velcro, nails, adhesive pads, plastic cradles with adhesive pads, or any other form of hardware, clamping device, bracket, or adhesive can be used to secure the signal/sensor target assemblies 3 to respective targets 2.

It can be helpful to ensure that the signal/sensor target assemblies 3 on each of the targets 2 are able to reliably send and receive signals from the personal computing device 9. Radio frequency, Bluetooth, or any other form of wireless communication, transceivers send and receive signals wirelessly to each other, provided there is no interference between them. The personal computing device 9 has the ability to directly send wireless signals to the target assemblies 3, and vice versa, but some targets 2, depending on the type of material, may interfere with the signal since the signal must pass through the target 2 itself to reach the signal/sensor target assembly 3 on the rear face of the target 2. Because of this potential issue, a signal relay tower 5 may be used to relay a signal received from the personal computing device 9, or the central control hub 4 (if needed), to the signal/sensor target assemblies 3 on the target 2. FIG. 4 is a flow chart that depicts the movement of electronic, wireless, and visual signals within the system.

Figure 2:
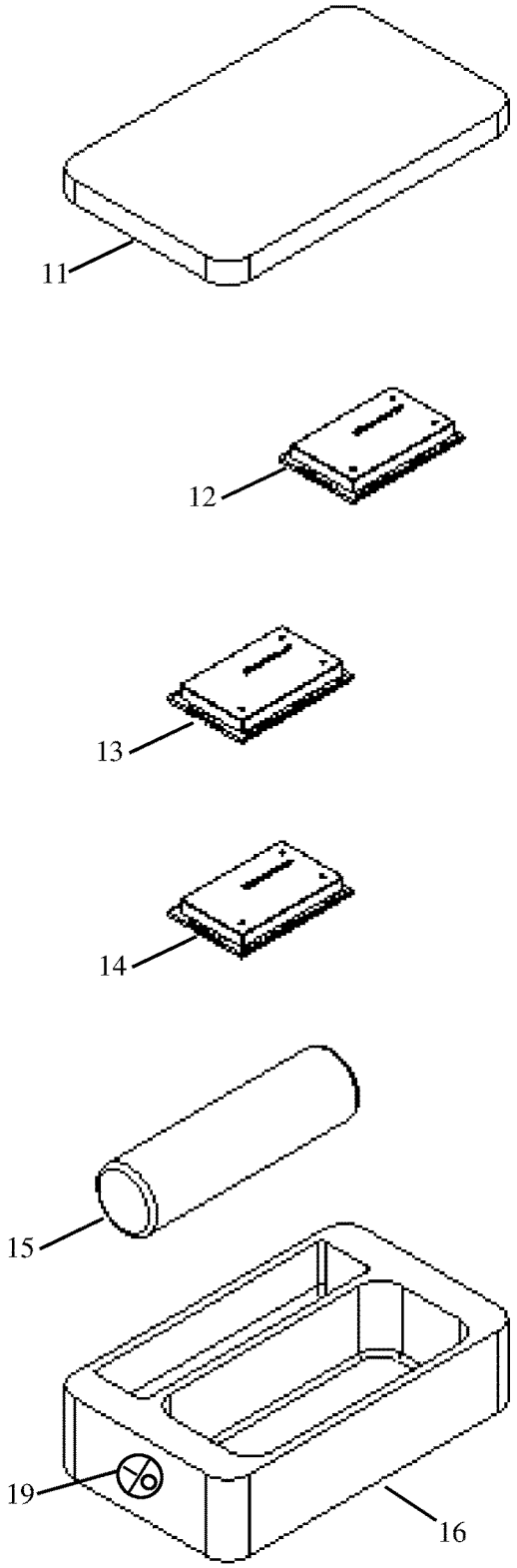
FIG. 2 is a diagram of an example hub unit in accordance with some implementations.

FIG. 2 shows an isometric exploded view of the central control hub 4. The central control hub 4 is utilized in a system that utilizes multiple forms of wireless communication. For example, a personal computing device may connect to the central control hub 4 via Bluetooth which the central control hub 4 then converts to another form of wireless communication, such as radio frequency, and sends the signals out to the other components in the system, i.e. the signal/sensor target assemblies 3, the signal extender 31, the signal relay tower, or a round counter 7. In some implementations, the central hub 4 comprises of a processor 13 that links to a wireless radio frequency, Bluetooth, or any other form of wireless communication, transceiver 12, a secondary radio frequency transceiver 14, if needed, a user interface 11 comprising of a display screen and keyboard, if the personal computing device 9 is a dedicated controller built into the central control hub, a battery 15 (rechargeable, replaceable, or both), and an On/Off switch 19 which are enclosed in a plastic water resistant body 16. A wired connection port can be provided and coupled to the central control hub processor 13 to permit updates to the application program(s) 26 from outside computing devices. The wired connection port also doubles as a charging port and can provide a power input for charging the central control hub's battery 15, if needed.

Figure 3:
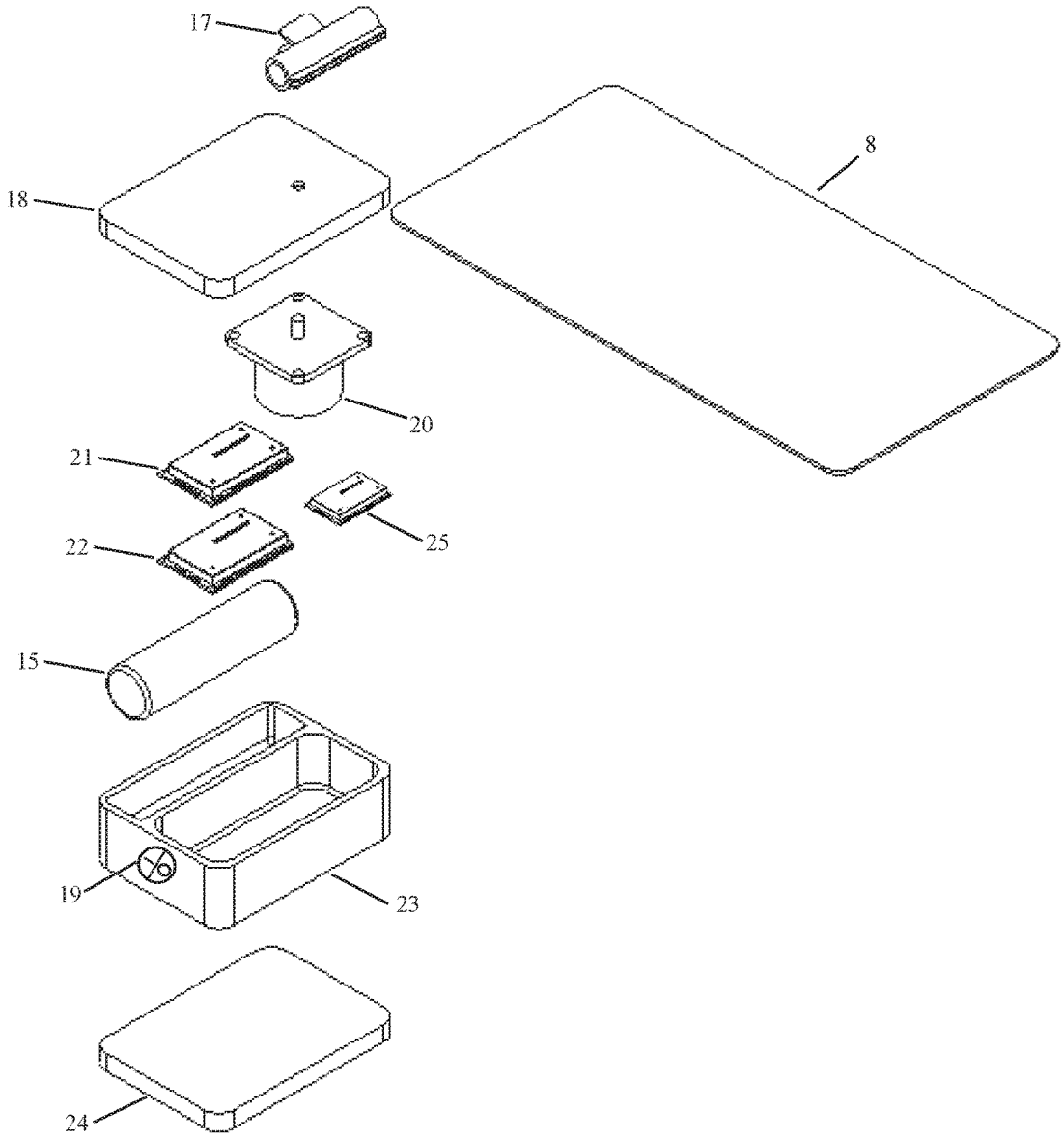
FIG. 3 is a diagram of an example attachable signal/sensor apparatus assembly in accordance with some implementations.

FIG. 3 shows an isometric exploded view of a signal/sensor target assembly 3. In the present embodiment, the signal/sensor target assembly 3 includes a plastic water-resistant body 23, a water-tight cover 18, an electric servo motor 20 (or other actuator for a mechanical or electrical active target signal such as an LED light or strobe light, etc.), a radio frequency transceiver 21, a processor 22, a projectile sensor 25, an On/Off Switch 19, an optional magnet 24 as an example of a type of attachment mechanism, a fastener mechanism or device to hold the activation signal that allows for replacement of the activation signal with or without tools 17, and a signal flag 8 as an active target signal. The signal flag 8 is held onto the assembly by the fastener mechanism or device 17 which permits the flag to be easily exchanged for a new one in the event of damage to the flag or if the shooter 1 prefers a different flag color. In some implementations, the signal flag 8 can include a thin rectangular piece of plastic of a highly visible color. Alternatively, the active target signal 8 could be a cloth flag, a paper flag, a cardboard flag, signal made of other suitable material, a light emitting diode (LED), a filament bulb or any other form of light emitting device, or an audible signal.

FIG. 1 also shows a round counter 7 attached to the shooter's 1 firearm 6. The round counter 7 determines the number of projectiles 10 that are fired from the firearm 6. The round counter 7 includes a vibration sensor (e.g., an accelerometer or other suitable sensor), a processor, and a transceiver and is attached to the firearm (e.g., on a Picatinny rail). Alternatively, the firearm round counter 7 could be mounted using a strap, adhesive, or a clamping device that uses friction to hold it to the barrel, barrel shroud, handle, grip, butt stock, or any other part of the firearm 6.

When a projectile 10 is fired from the firearm 6, the sensor in the round counter 7 can detect the vibration resulting from firing the projectile. Alternatively, the round counter 7 can include a microphone to detect the audible report of the projectile 10 exiting the barrel of the firearm 6. The signal generated from either sensor (e.g., vibration or audio) will then be sent to the round counter processor and then wirelessly relayed to the user's personal computing device 9, either directly or through a central control hub 4, via the round counter transceiver.

If a central control hub 4 is utilized, the central control hub transceiver 14 will receive the signal from firearm round counter 7 and send the information to the central control hub processor 13. The processor 13 will store the information received from the firearm round counter 7 and can include a count of rounds fired in results for the target shooting round (e.g., for reporting shooter accuracy, etc.). The application program 26 can store data received from the firearm round counter 7.

When a signal/sensor target assembly 3 gets prompted to activate the target signal, the servo motor 20 (or other actuator) on that target will rotate the active target signal flag 8 (or other indicator) from behind the target and into the shooter's line of sight. The shooter 1 has the option to select, via the application program, the movement of the servo motor 20 to help him or her see the active target signal 8 better. The application program 26 can have the servo motor 20 rotate the signal flag 8 out to a set position and hold it, rotate the servo motor 20 at a constant speed in a complete circle, or wave the servo motor 20 back and forth (e.g., 180 degrees) until deactivation.

Once the shooter 1 sees the active target signal 8, he or she can engage the target with his or her firearm 6. If a projectile 10 from the firearm 6 strikes a target 2 while it is active, the projectile sensor 25 will read the impact and send the information to the target assembly processor 22. The target processor 22 then reads the hit and relays the information back to the personal computing device 9, either directly or through the central hub assembly via the target assembly transceiver 21. The signal/sensor target assembly 3 also has the ability to send a radio frequency signal, or other form of wireless communication, directly to the central control hub 4 or through the relay tower 5. The application program 26 can store data received from the signal/sensor target assembly 3 (e.g., while the target 2 is active, or while the target 2 is inactive to record a shot on a target that is not active).

If the shooter 1 fails to hit a target 2 while it is active, the active target signal 8 will retract behind the target and out of the shooter's 1 line of sight after the designated amount of time set in the application program 26 (e.g., time set by the shooter 1 or determined by the application program 26). The target assembly processor 22 will read the absence of a hit and relay the information back to the personal computing device 9 in the same manner as if it registered a hit. The personal computing device 9, or the central control hub transceiver 14, will receive the signal from the signal/sensor target assembly 3 and send the information to the central control hub processor 13. The processor 13 stores the information received from the signal/sensor target assemblies 3 and bases the end results on information received from the signal/sensor target assemblies 3. The application program 26 can store data received from the signal/sensor target assemblies 3.

Once the application program 26 has activated the number of targets the shooter 1 designated at the start of the round, the round ends and the application program 26 will compile the data received from the signal/sensor assemblies 3 and optionally from the round counter 7. The results from the round are then displayed on the personal computing device 9. The data that is displayed at the end of each round can include the number of targets activated during the round, the number of targets hit with a projectile, the number of rounds fired, the average time it took the shooter 1 to hit the targets, and the shooter's 1 accuracy (e.g., percentage of targets hit, rounds fired per target hit, etc.).

Figure 5:
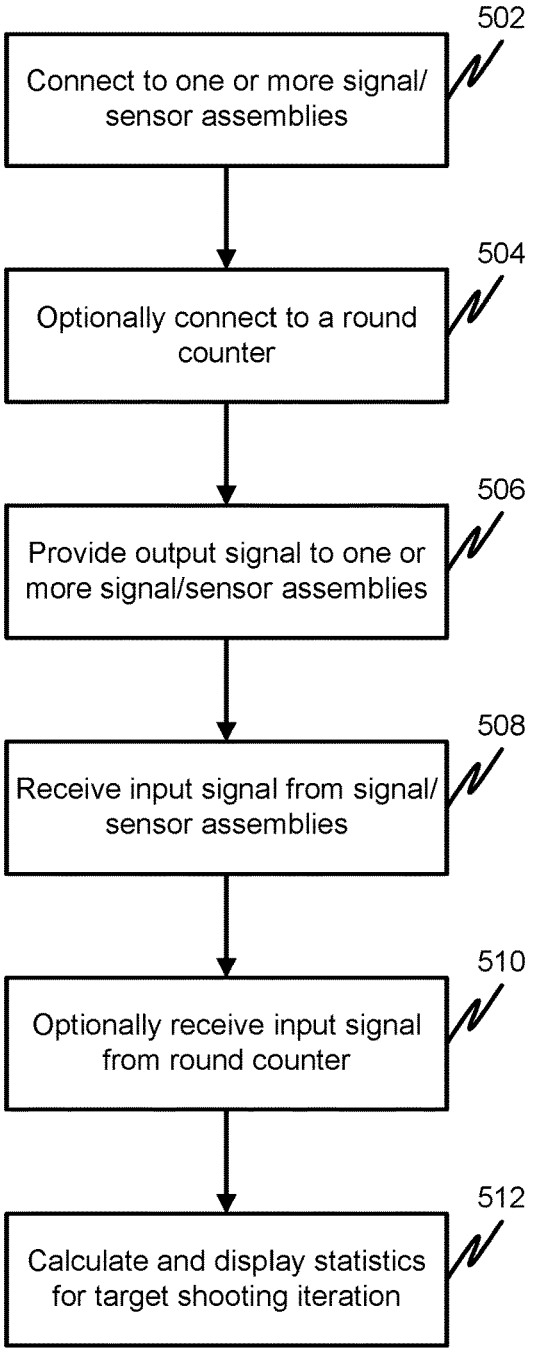
FIG. 5 is a flowchart of an example method for controlling a target system in accordance with some implementations.

FIG. 5 is an example flowchart of an example method of controlling a target shooting system. Processing begins at 502, where a computing device (e.g. 9) connects to at least one target signal/sensor assembly (e.g., 3). The computing device can also connect to a signal extender, a wireless repeater or other system components. Processing continues to 504.

At 504, the computing device optionally connects to a round counter configured to be attached to a weapon and to sense firing of a projectile from the weapon. Processing continues to 506.

At 506, the computing device provides an output signal to the at least one target signal/sensor assembly to activate or deactivate the active target signal. The output signal can be provided according to a target shooting iteration sequence being executed by the computing device. Processing continues to 508.

At 508, the computing device receives an input signal from the at least one target signal/sensor assembly indicating whether one or more target hits were sensed during a time period the active target signal is activated. Processing continues to 510.

At 510, the computing device optionally receives a round count signal from the optional round counter. Processing continues to 512.

At 512, the computing device calculates and displays statistics for a round (or iteration) of target shooting based on the input signal and the round count signal.

Figure 6:
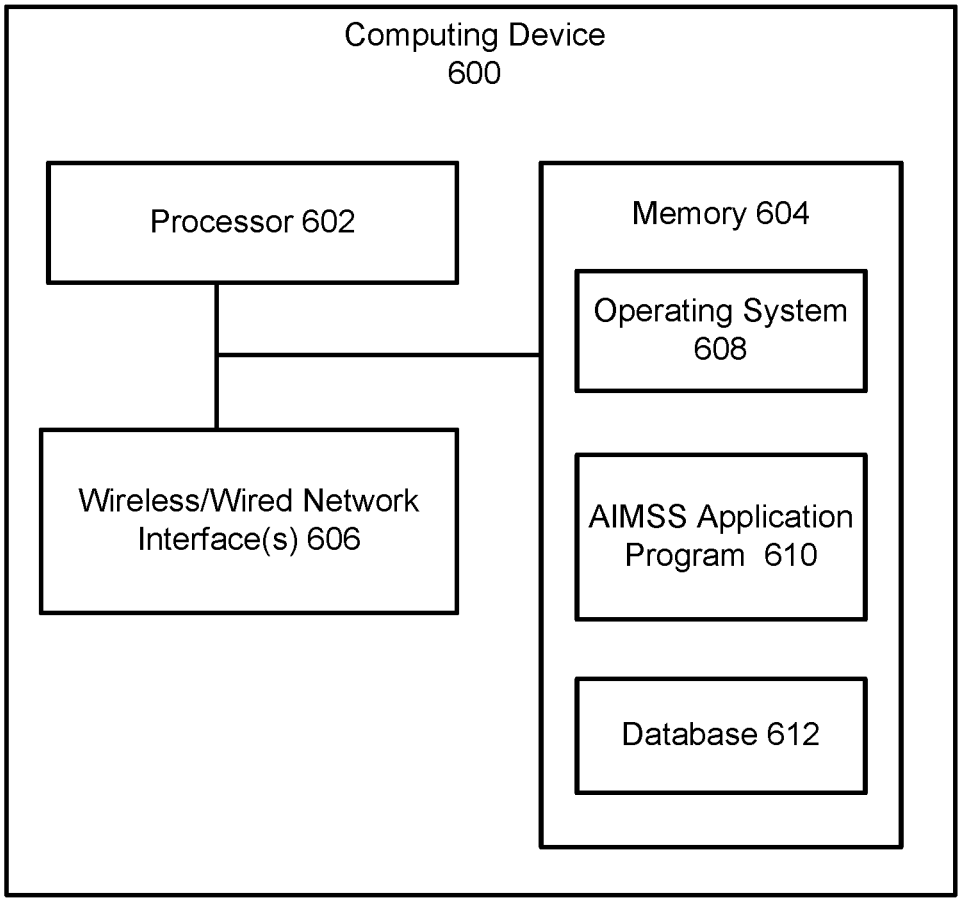
FIG. 6 is a diagram of an example computing device for a target system in accordance with some implementations.

FIG. 6 is a diagram of an example computing device 600 in accordance with at least one implementation. The computing device 600 includes one or more processors 602, nontransitory computer readable medium or memory 604, I/O interface devices 606 (e.g., wireless communications, etc.) and a network interface 608. The computer readable medium 604 may include an operating system 608, a target shooting application 610 for controlling a target shooting system (e.g., AIMSS) and a data section 612 (e.g., for storing shooting iteration programs or configuration parameters, shooting iteration statistics, etc.).

In operation, the processor 602 may execute the application 610 stored in the computer readable medium 604. The application 610 may include software instructions that, when executed by the processor, cause the processor to perform operations for a target shooting system in accordance with the present disclosure (e.g., performing one or more of the operations described in one or more of FIG. 5).

The application program 610 may operate in conjunction with the data section 612 and the operating system 608. The device 600 may communicate with other devices (e.g., signal/sensor devices, round counter, wireless extender, wireless relay, etc.) via the I/O interfaces 606.

It will be appreciated that one or more of 502-512 may be repeated, performed in a different order or performed periodically.

It will be appreciated that the modules, processes, systems, and sections described above may be implemented in hardware, hardware programmed by software, software instructions stored on a nontransitory computer readable medium or a combination of the above. A system as described above, for example, may include a processor configured to execute a sequence of programmed instructions stored on a nontransitory computer readable medium. For example, the processor may include, but not be limited to, a personal computer or workstation or other such computing system that includes a processor, microprocessor, microcontroller device, or is comprised of control logic including integrated circuits such as, for example, an Application Specific Integrated Circuit (ASIC). The instructions may be compiled from source code instructions provided in accordance with a programming language such as Java, C, C++, C#.net, assembly or the like. The instructions may also comprise code and data objects provided in accordance with, for example, the Visual Basic™ language, or another structured or object-oriented programming language. The sequence of programmed instructions, or programmable logic device configuration software, and data associated therewith may be stored in a nontransitory computer-readable medium such as a computer memory or storage device which may be any suitable memory apparatus, such as, but not limited to ROM, PROM, EEPROM, RAM, flash memory, disk drive and the like.

Furthermore, the modules, processes systems, and sections may be implemented as a single processor or as a distributed processor. Further, it should be appreciated that the steps mentioned above may be performed on a single or distributed processor (single and/or multi-core, or cloud computing system). Also, the processes, system components, modules, and sub-modules described in the various figures of and for embodiments above may be distributed across multiple computers or systems or may be co-located in a single processor or system. Example structural embodiment alternatives suitable for implementing the modules, sections, systems, means, or processes described herein are provided below.

The modules, processors or systems described above may be implemented as a programmed general purpose computer, an electronic device programmed with microcode, a hard-wired analog logic circuit, software stored on a computer-readable medium or signal, an optical computing device, a networked system of electronic and/or optical devices, a special purpose computing device, an integrated circuit device, a semiconductor chip, and/or a software module or object stored on a computer-readable medium or signal, for example.

Embodiments of the method and system (or their subcomponents or modules), may be implemented on a general-purpose computer, a special-purpose computer, a programmed microprocessor or microcontroller and peripheral integrated circuit element, an ASIC or other integrated circuit, a digital signal processor, a hardwired electronic or logic circuit such as a discrete element circuit, a programmed logic circuit such as a PLD, PLA, FPGA, PAL, or the like. In general, any processor capable of implementing the functions or steps described herein may be used to implement embodiments of the method, system, or a computer program product (software program stored on a nontransitory computer readable medium).

Furthermore, embodiments of the disclosed method, system, and computer program product (or software instructions stored on a nontransitory computer readable medium) may be readily implemented, fully or partially, in software using, for example, object or object-oriented software development environments that provide portable source code that may be used on a variety of computer platforms. Alternatively, embodiments of the disclosed method, system, and computer program product may be implemented partially or fully in hardware using, for example, standard logic circuits or a VLSI design. Other hardware or software may be used to implement embodiments depending on the speed and/or efficiency requirements of the systems, the particular function, and/or particular software or hardware system, microprocessor, or microcomputer being utilized. Embodiments of the method, system, and computer program product may be implemented in hardware and/or software using any known or later developed systems or structures, devices and/or software by those of ordinary skill in the applicable art from the function description provided herein and with a general basic knowledge of the software engineering and computer networking arts.

Moreover, embodiments of the disclosed method, system, and computer readable media (or computer program product) may be implemented in software executed on a programmed general purpose computer, a special purpose computer, a microprocessor, a network server or switch, or the like.

It is, therefore, apparent that there is provided, in accordance with the various embodiments disclosed herein, methods, systems and computer readable media for a target shooting system.

While the disclosed subject matter has been described in conjunction with a number of embodiments, it is evident that many alternatives, modifications and variations would be, or are, apparent to those of ordinary skill in the applicable arts. Accordingly, Applicants intend to embrace all such alternatives, modifications, equivalents and variations that are within the spirit and scope of the disclosed subject matter. It should also be understood that references to items in the singular should be understood to include items in the plural, and vice versa, unless explicitly stated otherwise or clear from the context. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

There are several important differences between the system disclosed herein and prior art systems. For example, some differences include:

(1) AIMSS is an electronic apparatus that attaches to a target to provide an active target signal with bullet hit and miss detection to the shooter instead of the target having proprietary and integrated hardware and/or software built in.

AIMSS provides an activation signal that is separate from the target itself since it is an attachable apparatus instead of the movement of the target itself being the active target signal;

(2) AIMSS is a modular and expandable system that is not limited to a fixed number of targets; and (3) AIMSS can utilize a round counter to determine accuracy of the shooter based on the number of bullets fired in addition to the number of targets not hit.

While the principles of the disclosed subject matter have been described herein, it is to be understood by those skilled in the art that this description is made only by way of example and not as a limitation as to the scope of the disclosed subject matter. Other embodiments are contemplated within the scope of the disclosed subject matter in addition to the exemplary embodiments shown and described herein.

What is claimed is:

1. A target shooting system comprising:

at least one target assembly, the target assembly configured to be attached to a corresponding target and including an active target indicator, an actuator, at least one hit sensor, and a target assembly transceiver; and a computing device configured to communicate with the at least one target assembly, the computing device being configured to:

provide an output signal to the at least one target assembly to activate or deactivate the active target indicator;

receive an input signal from the at least one target assembly indicating whether a target hit was sensed during a time period the active target indicator is activated; and calculate and display results and statistics for an iteration of target shooting based on the input signal, wherein the active target indicator includes a signal flag that moves independently from a target associated with the at least one target assembly.

2. The target shooting system of claim 1, wherein the signal flag is configured to transition from a first position to a second position in which the signal flag is within view to indicate the target the at least one target assembly is associated with is an active target.

3. The target shooting system of claim 1, wherein the actuator is a mechanical actuator configured to move the active target indicator between the first position and the second position.

4. The target shooting system of claim 3, wherein the mechanical actuator is a servo motor.

5. The target shooting system of claim 1 further comprising a round counter configured to be attached to a weapon and to sense firing of a projectile from the weapon, the round counter including a projectile firing sensor, a round counter processor, a round counter transceiver, and an accelerometer to sense recoil from a projectile being fired.

6. The target shooting system of claim 1 further comprising a round counter configured to be attached to a weapon and to sense firing of a projectile from the weapon, the round counter including a projectile firing sensor, a round counter processor, a round counter transceiver, and an acoustic sensor to sense a report from the projectile being fired from the weapon.

7. The target shooting system of claim 1 further comprising a target associated with the at least one target assembly, wherein the target is configured to be hit by a projectile.

8. A target shooting system comprising:

at least one target assembly, the target assembly configured to be attached to a corresponding target and including an active target indicator, an actuator, at least one hit sensor, and a target assembly transceiver, wherein the least one target assembly is configured to:

receive an input signal to activate or deactivate the active target indicator from an external device; and transmit an output signal from the at least one target assembly indicating whether a target hit was sensed during a time period the active target indicator is activated to the external device, wherein the active target indicator includes a signal flag that moves independently from a target associated with the at least one target assembly.

9. The target shooting system of claim 8, wherein the signal flag is configured to transition from a first position in which the signal flag is generally hidden from view to a second position in which the signal flag is within view to indicate the target the at least one target assembly is associated with is an active target.

10. The target shooting system of claim 8, wherein the actuator is a mechanical actuator configured to move the active target indicator between the first position and the second position.

11. The target shooting system of claim 10, wherein the mechanical actuator is a servo motor.

12. The target shooting system of claim 8, further comprising a round counter configured to be attached to a weapon and to sense firing of a projectile from the weapon, the round counter including a projectile firing sensor, a round counter processor and a round counter transceiver, wherein the round counter is configured to transmit a round count signal to the external device.

13. The target shooting system of claim 12, wherein the projectile firing sensor includes an accelerometer configured to sense recoil from a projectile being fired by the weapon.

14. The target shooting system of claim 12, wherein the projectile firing sensor includes an acoustic sensor configured to sense a report from the projectile being fired from the weapon.

15. The target shooting system of claim 8 further comprising a target associated with the at least one target assembly, wherein the target is configured to be hit by a projectile.

16. A method of controlling a target shooting system, the method comprising:

connecting, at a computing device, to at least one target assembly, the target assembly configured to be attached to a corresponding target and including an active target indicator, an actuator, at least one hit sensor, and a target transceiver;

and providing, from the computing device, an output signal to the at least one target assembly to activate or deactivate the active target indicator;

receiving, at the computing device, an input signal from the at least one target assembly indicating whether a target hit was sensed during a time period the active target indicator is activated;

and calculating, at the computing device, statistics for a round of target shooting based on the input signal, wherein the active target indicator includes a signal flag that moves independently from a target associated with the at least one target assembly.

17. The method of claim 16, further comprising communicating with a relay tower configured to receive and transmit signals between the computing device and the at least one target assembly.

18. The method of claim 16, wherein the signal flag is configured to transition from a first position in which the signal flag is generally hidden from view to a second position in which the signal flag is within view to indicate the target the at least one target assembly is associated with is an active target.

19. The method of claim 16, wherein the method further comprises connecting the computing device to a round counter configured to be attached to a weapon and to sense firing of a projectile from the weapon, the round counter including a projectile firing sensor, a round counter processor and a round counter transceiver, and wherein the projectile firing sensor includes one of an accelerometer to sense recoil from a projectile being fired, or an acoustic sensor to sense a report from the projectile being fired from the weapon.

* * * * *